US005348416A

United States Patent [19]

Ivey et al.

[11] Patent Number: 5,348,416

[45] Date of Patent: Sep. 20, 1994

[54] GANDY DANCER: END PIECE FOR CRASH CUSHION OR RAIL END TREATMENT

[75] Inventors: Don L. Ivey, Bryan; King K. Mak, San Antonio, both of Tex.

[73] Assignee: The Texas A&M University System, College Station, Tex.

[21] Appl. No.: 864,848

[22] Filed: Apr. 7, 1992

[51] Int. Cl.[5] ..... E01F 15/00

[52] U.S. Cl. ..... 404/6; 256/13.1

[58] Field of Search ..... 404/6, 7, 10, 9; 256/13.1; 188/371, 373; 238/17

[56] References Cited

U.S. PATENT DOCUMENTS

| | | | |
|---|---|---|---|
| 3,690,619 | 9/1972 | Kendall | 256/13.1 |
| 4,330,106 | 5/1982 | Chisholm | 256/13.1 X |
| 4,739,971 | 4/1988 | Ruane | 256/13.1 |
| 4,784,515 | 11/1988 | Krage et al. | 404/6 |
| 4,909,661 | 3/1990 | Ivey | 404/6 |
| 5,069,576 | 12/1991 | Pomero | 404/6 |
| 5,078,366 | 1/1992 | Sicking et al. | 404/6 X |
| 5,156,485 | 10/1992 | Ivey et al. | 404/6 |
| 5,217,318 | 6/1993 | Peppel | 256/13.1 X |

FOREIGN PATENT DOCUMENTS

| | | | |
|---|---|---|---|
| 94846 | 11/1983 | European Pat. Off. | 256/13.1 |
| 1295582 | 5/1969 | Fed. Rep. of Germany | 256/13.1 |
| 2651811 | 3/1991 | France | 256/13.1 |
| 2193990 | 2/1988 | United Kingdom | 404/9 |

*Primary Examiner*—Ramon S. Britts
*Assistant Examiner*—James A. Lisehora
*Attorney, Agent, or Firm*—Arnold, White & Durkee

[57] ABSTRACT

A method of cushioning highway vehicle impacts and an improved end piece for a highway crash cushion or rail end treatment for concrete barriers or for guard rail terminals. The end piece has means to trap the bumper or other forward elements of an impacting vehicle. Additionally, the end piece is slidably mounted to traverse along a linear guide track or curvilinear guard rail during the progress of the collision as the vehicle is decelerated from contact velocity to a stop.

10 Claims, 6 Drawing Sheets

Fig. 1
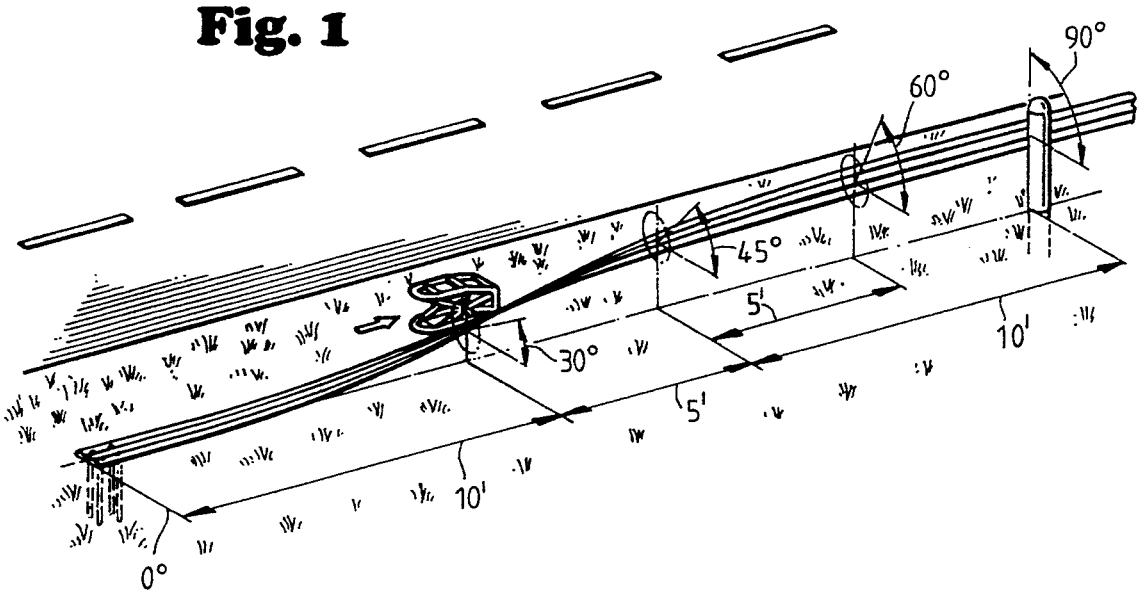
Fig. 2
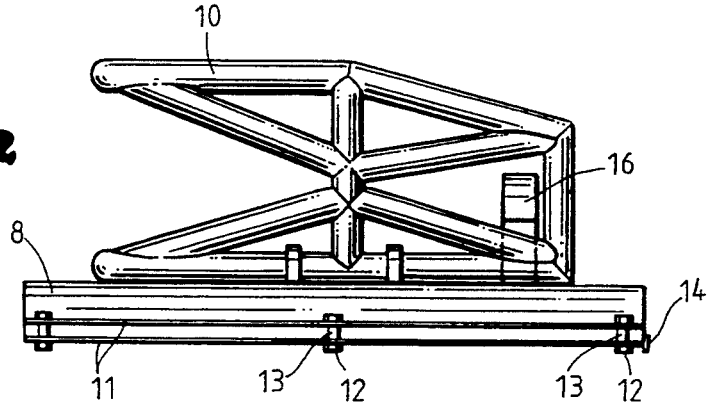
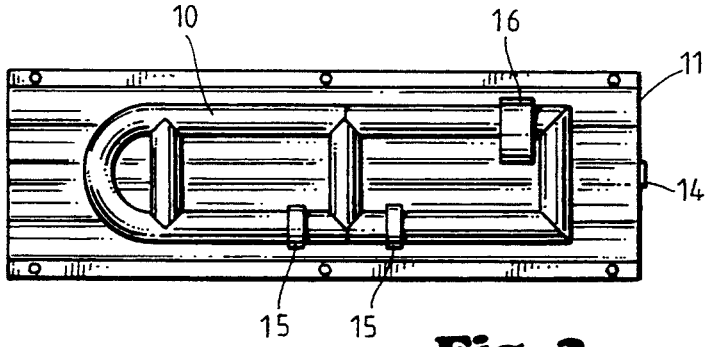
Fig. 3

Fig. 8A
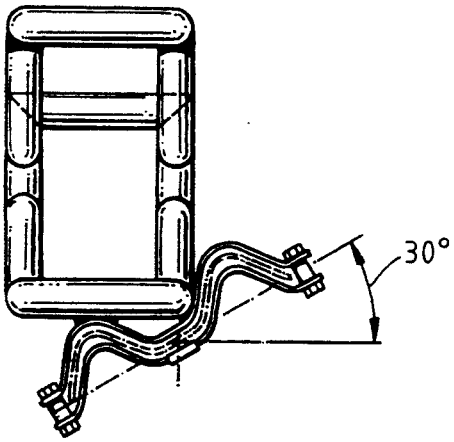
Fig. 8B
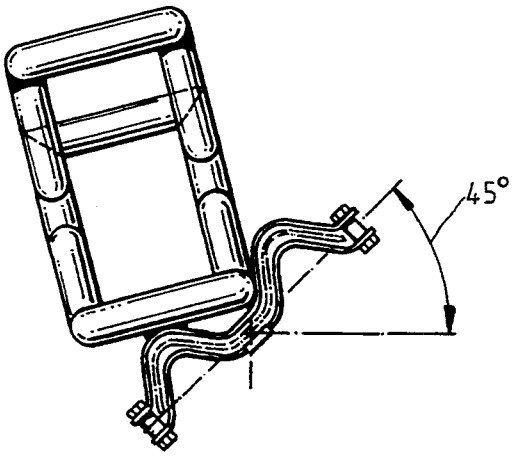
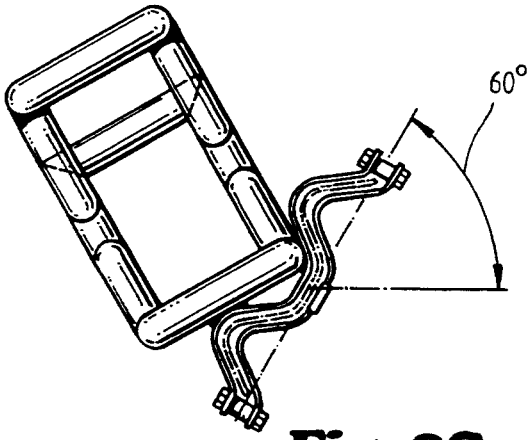
Fig. 8C
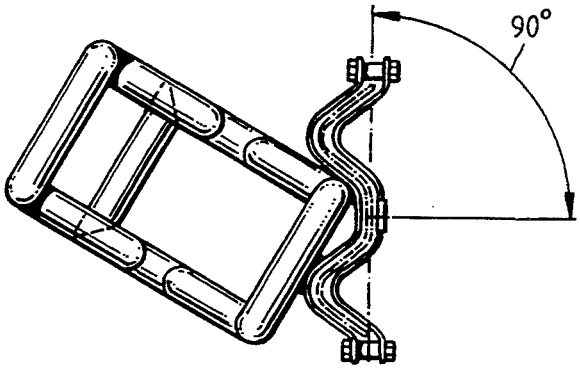
Fig. 8D

Fig. 12
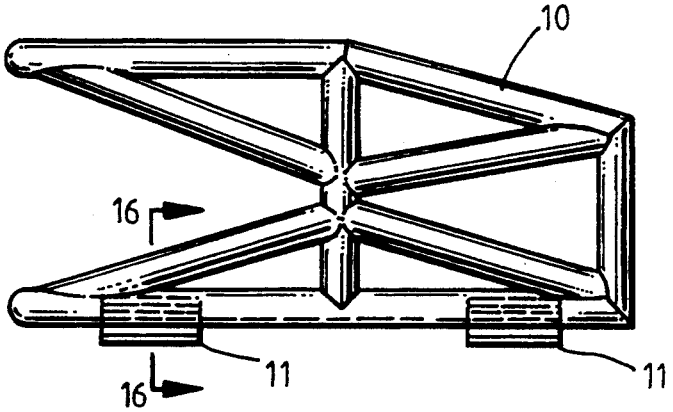
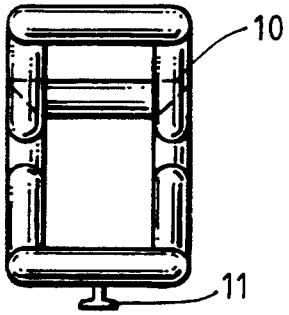
Fig. 13
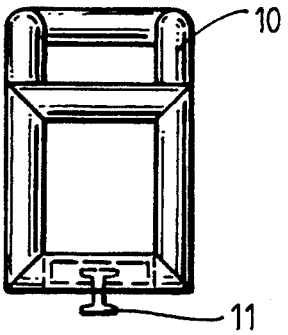
Fig. 14
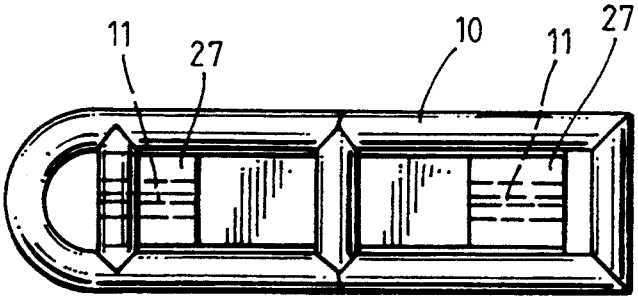
Fig. 15
Fig. 16
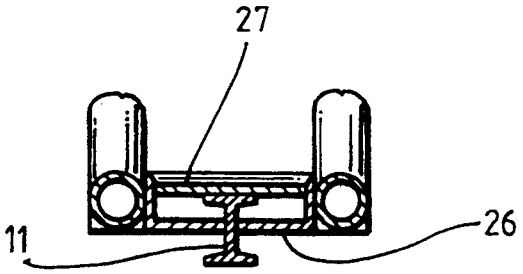

GANDY DANCER: END PIECE FOR CRASH CUSHION OR RAIL END TREATMENT

BACKGROUND OF THE INVENTION

1. Field of the Invention

The present invention generally relates to an improved end piece for highway crash cushions and other forms of road barriers. The end piece more particularly is configured to trap the bumper or other elements of an impacting vehicle, and to be movable along the barrier. In a preferred form, the end piece resists rolling of a vehicle and acts during the progress of a collision to help decelerate the vehicle from contact velocity to a stop. The end piece is especially useful with highway "turndown" guard rail terminals to help prevent the ramping phenomenon sometimes associated with such terminals. Additionally, the end piece may be used to help control impacts with Advanced Dynamic Impact Extension Module ("ADIEM") terminals. Such terminals are disclosed in U.S. Pat. No. 4,909,661, incorporated herein by reference.

2. Description of the Prior Art

Many existing guard rails have been built to terminate in a curvilinear "turndown" fashion such that a W-beam, box beam or the like structural member tapers down into the ground, thus providing a ramp to eliminate "spearing" tendencies of an otherwise raised end. While the "turndown" end treatments have successfully reduced the danger of a vehicle being penetrated in a head-on collision, it now appears that these end treatments may induce launching of the vehicle and cause it to become airborne for a considerable distance with the possibility of rollover. It is therefore desirable to develop a system of preventing such ramping, especially a system which could be readily retrofitted onto current "turndown" guard rails.

It is also desirable in the case of solid concrete road barriers to reduce the danger of deadly impact forces when vehicles crash against such barriers. Present barrier end treatments, designed for conventional height (typically about 32 inches) standard concrete median barriers ("CMB"), employ modules of crushable material, such as the ADIEM. The focus of such modules has been on cushioning the impact between a colliding vehicle and the solid barriers. In that regard, an alternative barrier design, known as the LP-IV Low Profile Barrier, has recently been developed which provides for a much lower profile than the CMB. The lower profile (preferably about 24 inches) has significant advantages; however, if the overall height of the ADIEM crash cushion system were decreased to about 24 inches or less (as in the low profile barrier application), an impacting vehicle might be expected to ramp on such a cushion or end treatment. Accordingly, there is a continuing need with road barriers for a means which will not only arrest a vehicle but also help to prevent ramping of the vehicle upon colliding with the barrier.

SUMMARY OF THE INVENTION

The present invention is directed at the problems described above. Thus, in a general aspect, the invention comprises an end piece which is positioned at the leading or upstream end of a road barrier, and which helps not only to decelerate a vehicle but also to stabilize the vehicle. The end piece is preferably crash-resistant so as to be capable of repeated use. The end piece is also configured at its leading end so as to engage the front end of a vehicle and restrain the vehicle from ramping or rolling. Thus, in one preferred form the leading end of the end piece is notched or otherwise shaped to receive and engage the bumper of a vehicle.

The end piece of the invention is mounted on any given road barrier so as to be pushed or otherwise moved along the barrier by an impacting vehicle.

In a preferred form, the improved highway crash cushion end piece of the invention is characterized by a frame which is mounted on a base. The frame is preferably notched or V-shaped so as to engage the bumper or other forward element of an impacting vehicle. The base, in turn, is designed to engage the end piece with a road barrier in a manner which enables the end piece to be forced along the barrier by an impacting vehicle. The base serves, in effect, as a shoe which holds the end piece on a guard rail or the like in a slidable or movable relation.

A feature of the end piece of the invention is that it enables a vehicle's bumper or other forward elements to be trapped by the frame and thus helps prevent ramping on the guard rail or other end treatment by holding the vehicle front end during the course of the collision. The frame is preferably constructed of material sufficiently strong and resilient to withstand repeated vehicle impacts without extensive damage.

One primary application of this invention is as an adaptation to a turndown guard rail terminal. In this embodiment, the notched or V-shaped frame of the end piece may either attach to the base portion by means which would allow for limited rotation of the frame relative to the base (see FIG. 4) or be fixed to the base portion preferably at an approximate angle of 30° (see FIG. 5). The base portion of the end piece as adapted for a W-shaped guard rail preferably comprises a pair of W-shaped plates connected by spacer/rollers, with one plate on each side of the guard rail. Thus, the two plates are movably mounted upon the W-beam of the guard rail, such that the end piece is able to run along the guard rail.

In an impact wherein the notched or V-shaped frame traps an impacting vehicle's bumper or other forward element, the end piece traverses the guard rail beam while restraining the vehicle from ramping on to the barrier itself. As the end piece traverses, the base portion ultimately orients itself toward an angle approximating 90° to the horizontal (see FIGS. 8A–SD).

As the traversing end piece encounters guard rail support posts, it is designed to detach the guard rail from these posts to help prevent a jolting stop to the impacting vehicle. The vehicle is slowed to a stop as a result of dissipation of kinetic energy through work done on the rail and posts and friction between the end piece and the rail.

As the traversing end piece encounters each such post, detachment of the rail from the posts may be accomplished by the use of rail sections having reinforced, tapered apertures which allow a connection bolt attaching the rail to the post to pass, upon impact, completely through the larger end of the aperture to disengage the rail. A number of methods exist for connecting the bolt to the post. One option, as illustrated in FIG. 10, provides for the connection bolt to be drilled through the post and fitted, on the head end, with a spacer and a 'bangee' designed to absorb a blow or bang from a reinforced 'bangor' coupled to the base portion of the traversing end piece. The bolt is secured with a nut on the opposite end. A second option for the bolt connection, as shown in FIG. 11, provides for the connection bolt to be drilled into the post to secure a drift ring which fits over the post. Similarly, the connection bolt is provided with a spacer and 'bangee' as described above. In both options described, the 'bangor' acts to impact the 'bangee' on an encountered post and, thus, force the connection bolt along the widening aperture in the W-beam section until it comes out of the slot, thereby releasing the rail from the post.

An alternative mode of practicing this invention comprises use of the end piece as a substitute for the first module of crushable concrete in a low-profile ADIEM crash cushion. The end piece base portion is slidably inserted into a linear guide channel which may be formed, for example, by two parallel I-beam sections embedded in the structural concrete base for the first module. During the course of a collision, the end piece traverses the guide track as the vehicle is decelerated from contact velocity to a stop. The base portion of the end piece, in this configuration, may comprise flanged beam segments, such as I-beam segments. The I-beam segments are each fixedly mounted on their upper flange to a horizontal plate which supports the notched or V-shaped frame.

With the end piece used in this latter embodiment it may also serve as an end treatment for an adjoining low profile barrier such as the LP-IV Low Profile Barrier. The low profile of the end piece will preserve the visibility advantage of the low profile barrier system and reduces the lack of visibility associated with higher profile end pieces designed to accommodate conventional height barriers such as the standard CMB.

BRIEF DESCRIPTION OF THE DRAWINGS

Further details are explained below with the help of the examples illustrated in the attached drawings in which:

FIGS. 1–8 show the invention employed as an end treatment for a "turndown" guard rail terminal.

FIG. 1 is an perspective view of the invention embodied as an improvement to a "turndown" guard rail terminal.

FIG. 2 is a side view of the end of FIG. 1.

FIG. 3 is a top view of the end piece of FIG. 1.

FIG. 4 is a front end view of the end piece of FIG. 1 with the frame attached to the base portion so as to allow for limited rotation of the frame.

FIGS. 5 and 6 illustrate the end piece of FIG. 1 with the frame fixedly attached to the base portion.

FIG. 7 demonstrates angular rotation of the base portion of an end piece during traversal of a "turndown" guard rail terminal.

FIGS. 8A through 8D are front end views which illustrate angular rotation of the end piece in FIGS. 5 and 6 during traversal of a "turndown" guard rail terminal.

FIGS. 12–18 show the invention employed as a replacement for the first module in a low-profile ADIEM terminal.

FIG. 12 is a side view of an end piece embodied as a replacement for the first module in a low-profile ADIEM terminal.

FIG. 13 is a front view of the end piece of FIG. 12.

FIG. 14 is a rear view of the end piece of FIG. 12.

FIG. 15 is a top view of the end piece of FIG. 12.

FIG. 16 depicts a cross sectional view of a base plate and base member taken along section lines 16–16 in FIG. 12.

FIG. 17 is a perspective view showing the end piece of FIG. 12 slidably mounted in a low-profile ADIEM barrier configuration.

FIG. 18 is an end view of the end piece of FIG. 17 slidably mounted in a low-profile ADIEM barrier configuration.

DETAILED DESCRIPTION OF THE PREFERRED EMBODIMENTS

Figure 5:
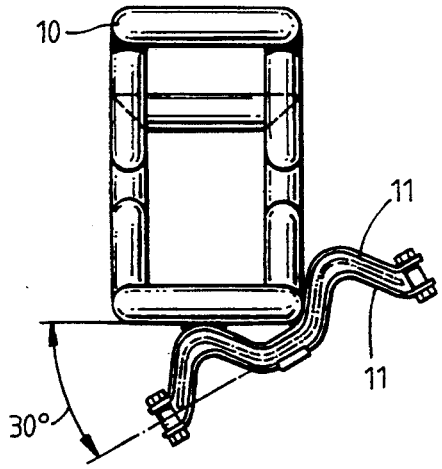
Figure 6:
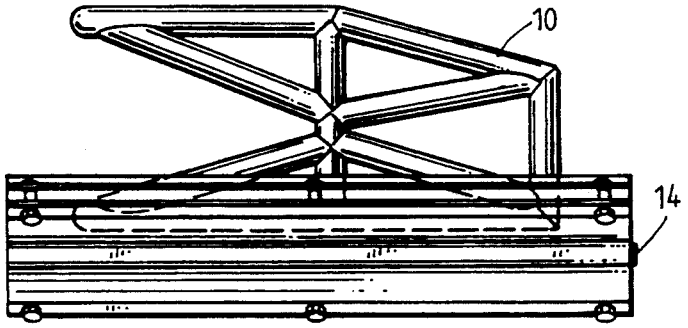
Figure 7:
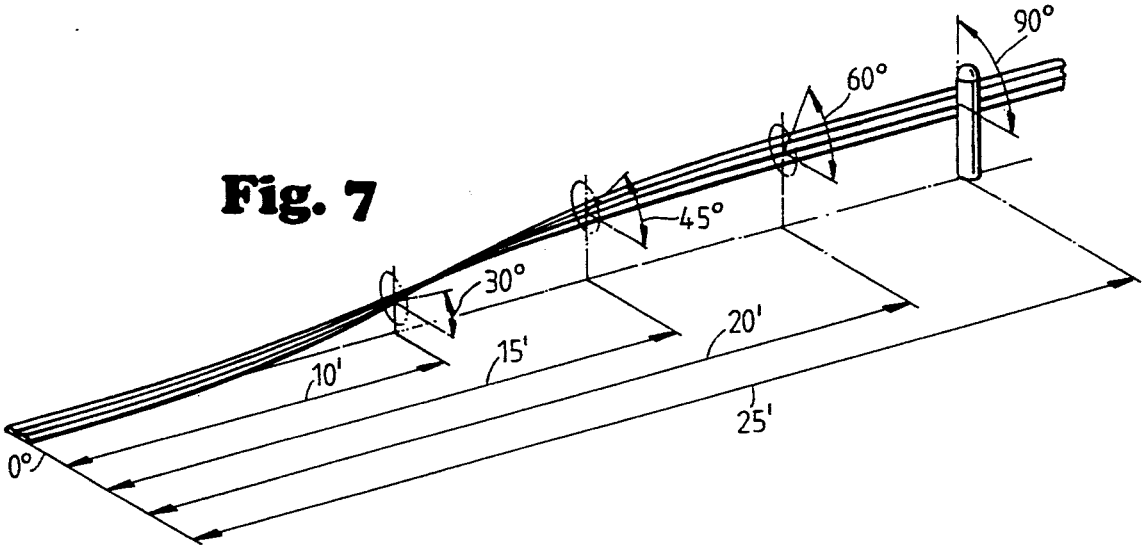

A preferred embodiment of the present invention is depicted by FIGS. 1–11. As shown in these figures, the end piece is embodied as an improvement for a "turndown" style guard rail. FIG. 1 is a perspective view of the end piece attached in sliding relation to a typical "turndown" style guard rail. During traversal in the direction of the arrows in FIG. 1, the base members of the end piece should angularly rotate as shown to remain in accordance with the orientation of the guard rail beam. FIG. 7 further depicts the distance and rotation relationship.

Figure 4:
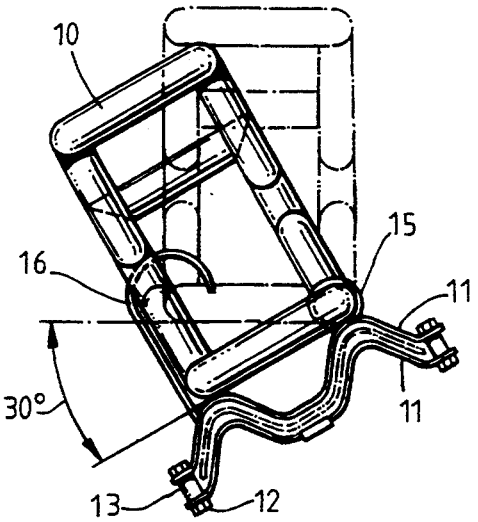

FIGS. 2 through 4 show one embodiment of the end piece of the invention in greater detail. The end piece comprises a frame 10 and base 8. Frame 10 may comprise a network of rigid members such as hollow pipe. In a particularly preferred embodiment, the frame is constructed of approximately 2 3/8 " O.D. pipe with $\frac{1}{4}$" wall thickness. The pipe segments may be joined by welding, by the use of couplers and elbows, or by other means providing for strong connections. Those skilled in the art will recognize that other materials may be used to construct a strong, resilient frame as well.

The base 8 depicted here comprises two rigid flanged beam segments 11 which are W-shaped so as to fit against opposite sides of the contour of a W-shaped guard rail beam. The base members 11 are held together using connecting means 12 and separated by spacer/-rollers 13. The guard rail is effectively sandwiched by the two base members. The end of at least one base member 11 may be fitted with a reinforced "bangor" 14, as will be described later.

FIGS. 2 through 4 show the frame 10 connected to the base 8 so as to allow for limited rotation of the frame relative to the base members. The connection is best shown by FIG. 4. Such rotation is permitted by loops or other hinge means 15 and rotation limiter 16. The loops 15 are secured to the upper base member, and are sized to rotatably couple the frame to pivot or hinge relative to the loops. The rotation limiter 16 may comprise simply a hook fastened at one end to the upper base member and bent to engage the frame.

As traversal of the end piece occurs along a guard rail beam in response to a vehicular impact, the base members tend to rotate angularly to maintain orientation with that of the guard rail beam. For the exemplary end piece found in FIG. 4, the base members would rotate in a counter-clockwise direction. This rotation would be substantially in accordance with the angles depicted in FIG. 7. The angles shown at 10, 15, 20 and 25 feet are 30°, 45°, 60° and 90°, respectively. Prior to a vehicular impact, the end piece is preferably positioned approximately 10 feet from the leading end of the guardrail so that the base members are initially oriented at about 30° from the horizontal. The above-described exemplary connection 15 rotatably couples the frame to said base members to enable the base members to rotate in a limited fashion independently of the frame. As a result, the angular orientation of the frame and impacting vehicle should remain relatively stable as the base members become laterally tilted toward a more vertical disposition.

FIGS. 5 and 6 depict an alternate method of connecting frame 10 to the base members 11, wherein the frame is fixedly attached so as to allow for no rotation. As shown in FIG. 5, the frame is preferably mounted so as to be offset approximately 30° from the plane of the base members. Again, prior to a vehicular impact, the end piece is preferably positioned approximately 10 feet from the leading end of the guardrail and the base members oriented at about 30° from the horizontal. Rotation of the end piece wherein the frame is attached in this manner, is illustrated in FIGS. 8A through 8D. By virtue of the initial mounting being offset counter to rotation along the guard rail, the angular displacement of the frame relative to the horizontal is reduced at later stages of the impact.

Figure 9:
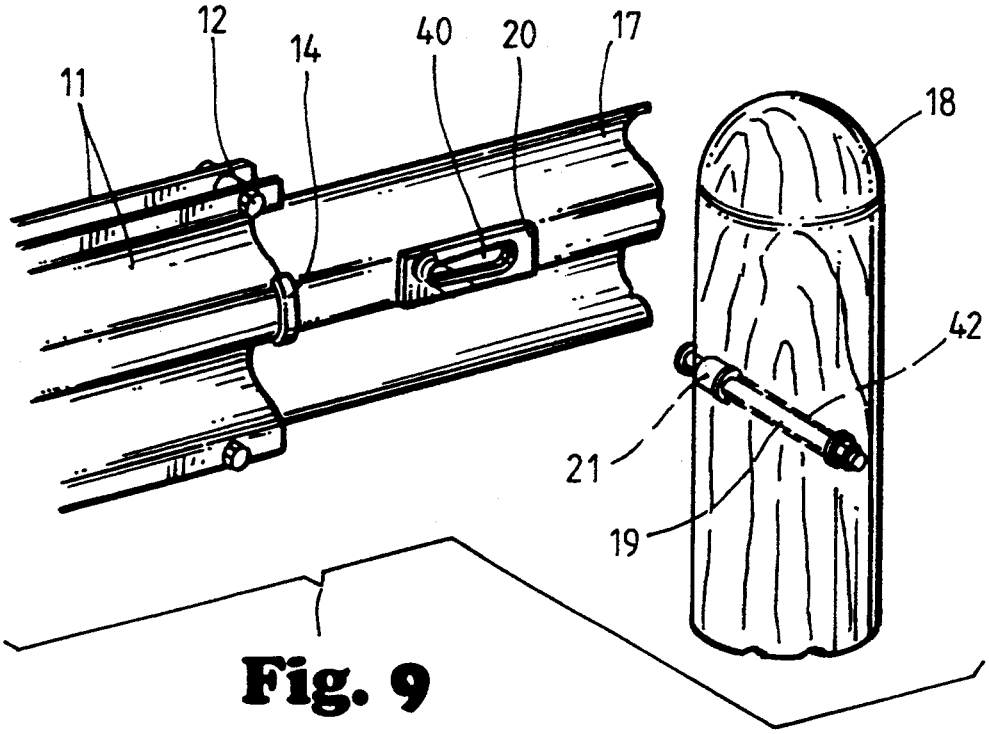
FIG. 9 is a partially exploded view of a post detachment means for the invention as adapted to a "turndown" guard rail terminal.
Figure 10:
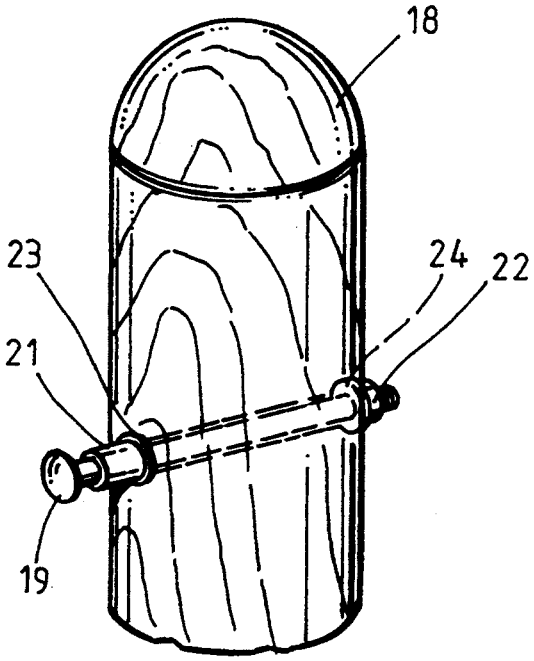
FIGS. 10 and 11 show alternate exemplary mechanisms for detachably mounting the guard rail to the support post.
Figure 11:
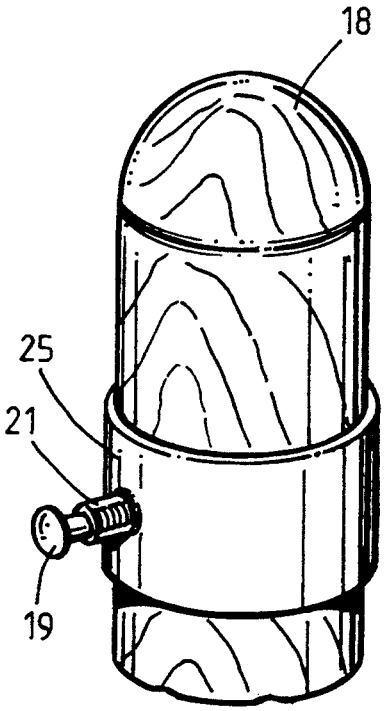

FIGS. 9 through 11 illustrate an exemplary means whereby a guard rail beam may be detached from a support post upon contact with the base of a traversing end piece of the invention. FIG. 9 is a partially exploded view of the mechanism of detachment. Guard rail beam 17 is normally attached to support post 18 by means of a bolt 19. In accordance with the invention, the bolt 19 passes through a tapered aperture 40 within reinforcement 20 and is securely affixed to post 18. Thus, bolt 19 passes through a hole 42 in the post 18. Bolt 19 is fitted with a reinforcing sleeve or "bangee" 21, which provides space between the beam 17 and the support post 18 and also protects the shaft of bolt 19 from lateral impacts.

When a vehicle strikes the end piece, the base members 11 of the end piece travel along the guard rail beam 17 until they encounter the reinforcement 20. At this point, the "bangor" 14 impacts "bangee" 21, thereby moving bolt 19 along the widening aperture in reinforcement 20. As bolt 19 is pushed from the narrow end toward the wide end of the aperture 40, the aperture becomes sufficiently large to enable the head of bolt 19 to escape from the aperture. Upon such disengagement of the bolt 19 from reinforcement 20, the guard rail beam 17 is released from post 18. This type of disengagement, of course, may occur at more than one post. As base members 11 traverse in moveable relation to guard rail beam 17, movement of base members 11 is retarded by friction with beam 17.

FIGS. 10 and 11 illustrate alternate exemplary methods for securely affixing bolt 19 to post 18. In FIG. 10, bolt 19 passes entirely through post 18 and is secured by a nut or other suitable means 22. In this configuration, the bolt may be fitted with washers 23 and 24. FIG. 11 displays attachment of the bolt to the post by means of a drift ring 25. The ring is placed around the circumference of the post. The ring is preferably provided with a threaded opening in the ring's surface to accommodate bolt 19. After being passed through guard rail beam 17, reinforcement 20, and bangee 21, bolt 19 is screwed into the threaded opening in drift ring 25 and then tightened against post 18. In both described configurations for affixing bolt 19, said bolt should be sufficiently tightened so that the bolt holds reinforcement 20 against bangee 21.

FIGS. 12 through 18 depict the invention in an alternative embodiment, as an improvement for a low-profile ADIEM style barrier. In this embodiment, the end piece serves as the first ADIEM module. FIGS. 12 through 15 provide various views of the end piece as used in this configuration. Frame 10 is substantially as described in the previous embodiment. The base is shown to comprise a plurality of flanged beam segments 11 fixedly attached to the frame. An exemplary means of attachment is shown in FIG. 16 which is a cross-sectional view taken along the lines 16—16 of FIG. 12. Base member 11 intersects channel section 26 and is firmly attached on its upper flange to plate 27. Channel 26 extends across the lower portion of the frame 10 and forms a box-like structure with the plate 27. Those skilled in the art will recognize, of course, that the frame and base members may be attached in other ways as well.

Figure 17:
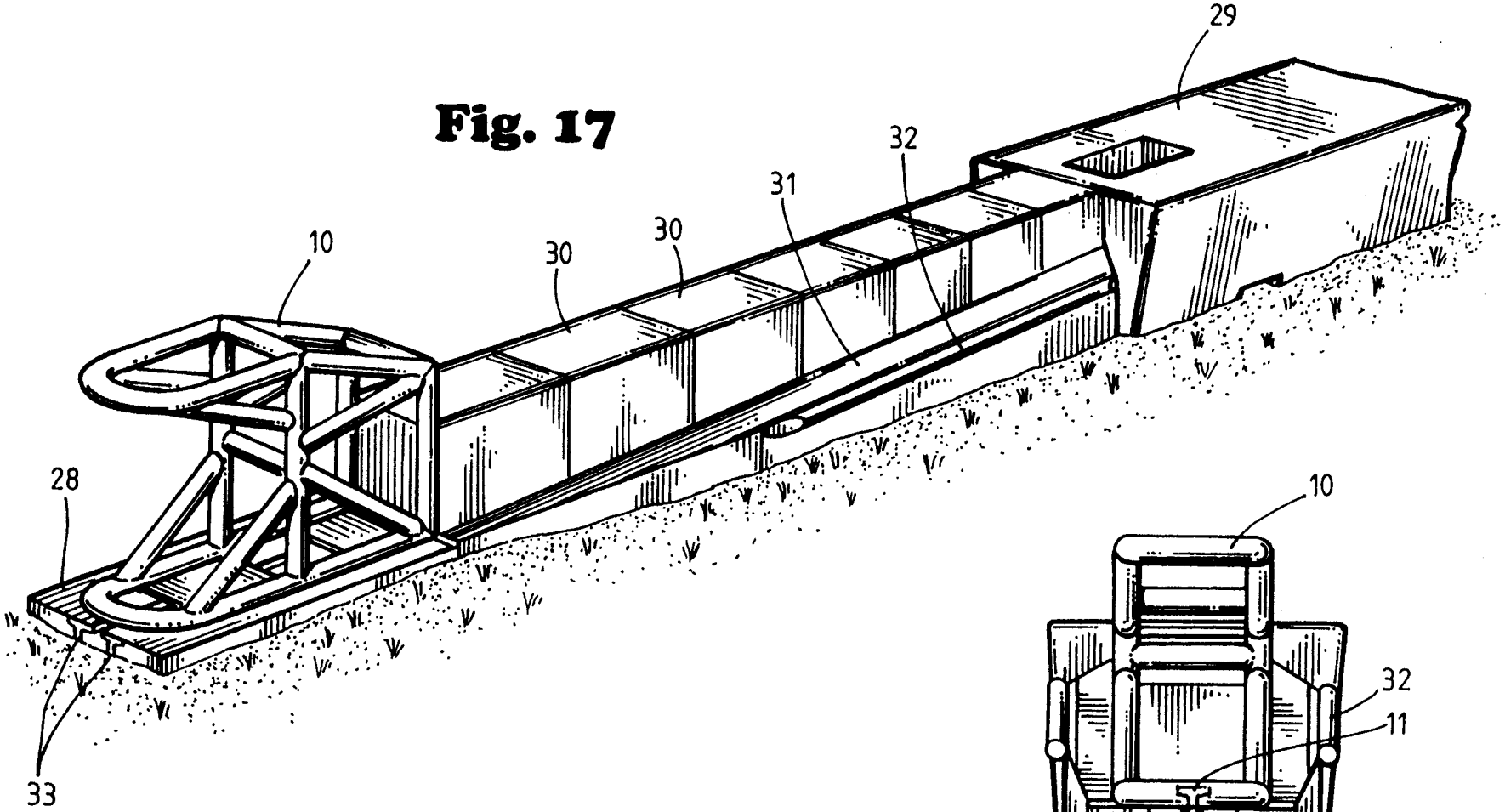
Figure 18:
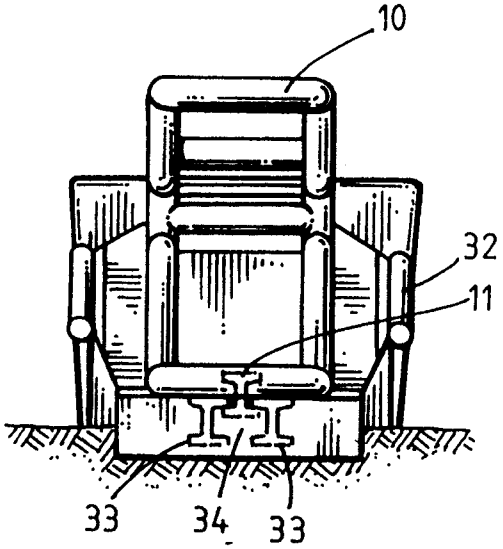

FIG. 17 is a perspective view of the end piece of FIGS. 12–16, as adapted to a low-profile ADIEM crash cushion and as an end treatment for a low profile barrier. Frame 10 rests upon pad 28 and adjoins an ADIEM crushable concrete-style, multi-module crash cushion as described in U.S. Pat. No. 4,909,661. The ADIEM crash cushion, in turn, adjoins a low profile concrete barrier 29, such as that described in U.S. patent application No. 07/691,392, by Don L. Ivey, Hayes E. Ross, Jr., and W. Lynn Beason, which is incorporated herein by reference. The crash cushion comprises a plurality of crushable concrete modules 30 adequate to substantially cushion the impact of a vehicle. In a preferred embodiment, the modules number from 7 to 9. In a particularly refined embodiment, a module's dimensions approximate 3′ in length, 11″ in width, and 10″ in height. As described more fully in U.S. Pat. No. 4,909,661, modules 30 are slidably engaged to base 31.

Pad 28 and base 31 should be constructed of strong, durable material such as structural concrete to bear the weight of the modules and end piece as well as withstand the effects of vehicular collisions. The height of base 31 preferably increases gradually beginning at the front of the base where the base adjoins pad 28, and continues proceeding toward the back of the base where barrier 29 is met. Optionally, holes may be drilled through base 31 and vertical dowels (not shown) may be inserted through said holes and used to secure the base to the roadway surface. A longitudinal member 32, in the nature of a pipe side runner, which may be used for lifting or carrying base 31, may be fixedly attached to base 31, preferably where the base is at its maximum height, as shown in FIG. 17.

In this embodiment, a guide track for the end piece 10 may comprise a channel 34 formed by parallel flanged beams 33 embedded in pad 28 and base 31, the beams being separated from each other by a space sufficient to receive the web and flange portion of corresponding flanged segments 11. The channel 34 should be continuous or allow continuous traversal by the base members 11 from the forward portion of pad 28 and along some length of base 31. In this respect, pad 28 and base 31 may be interconnected or constructed as a unitary piece.

The elevation of beams 33 rises in concert with that of base 31. In a particularly preferred configuration, the top of beams 33 at the forward edge of pad 28 would measure approximately 4" above the roadway surface, the tops of said beams being flush with the top of the pad. The beam tops would increase in elevation to approximately 16" at the distant end of base 31.

In a collision, the impacting vehicle engages the end piece, including frame 10, against the crushable modules 30. At the same time, base members 11 traverse the channel 34 defined between beams 33 and enable frame 10 to consecutively crush modules 30. The combined effect of the resistance exerted by the crushable modules 30 and the resistance exerted by the coaction of the undercarriage of the impacting vehicle as it encounters drag caused by the increasing elevation of base 31 results in the vehicle coming to a stop before encountering the end portion of barrier 29.

Various modifications and improvements may be made to the disclosed embodiments of the present invention without departing from the overall scope and spirit of the invention.

What is claimed is:

1. An end piece for a road barrier comprising:

(a) an upper metal frame portion configured at one end to trap the forward elements of an impacting vehicle; and (b) a base portion attached to and below the metal frame portion, said base portion comprising a pair of corrugated base members which are interconnectable to sandwich a guard rail between them and move in a sliding relation along said guard rail in response to a vehicular collision, said base portion further comprising a bangor for impacting a support post connector to disengage the guard rail from a support post as the base portion slidably arrives at the support post.

2. The end piece of claim 1, further comprising a support post secured to a bolt, and a guardrail beam configured to detachably connect to the support post by receiving a portion of the bolt in a tapered aperture defined in the guardrail beam, wherein the bangor comprises a reinforced member to disengage the bolt from the guardrail beam by urging the bolt toward a widened end of the aperture.

3. A guardrail terminal for use proximate an end of a roadside barrier, the terminal comprising:

(a) a guardrail adapted to extend longitudinally alongside a road;

(b) an end piece engaging the guardrail in moveable relation thereamong, the end piece comprising:

an upper portion comprising a metal frame having a leading end configured to trap forward elements of a vehicle impacting the leading end.; and a base portion below and attached to the upper portion and configured to engage the guardrail in moveable relation along the guardrail, said base portion comprising a pair of base members positionable on opposite sides of the guardrail;

(c) at least one guard rail support post; and (d) a connector adapted to connect the guard rail to the support post such that the end piece traversing the guard rail is operable to impact the connector so as to disengage the guard rail from the support post as the connector is encountered by the end piece.

4. The guard rail terminal of claim 3 further including a reinforced bangor coupled to said base portion.

5. The guard rail terminal of claim 4 in which the guard rail comprises an impact-absorbing bangee fitted upon said connector which, when impacted upon by said bangor, will move the connector along a widening aperture in said guard rail until said connector comes out of the aperture to disengage the rail from the support post.

6. The guard rail terminal of claim 5 in which said guard rail includes at least one tapered aperture operable to retain said connector at the narrower end of the aperture and to pass the connector at the larger end of the aperture.

7. An end piece for a road barrier extending longitudinally alongside a road, comprising:

(a) an upper portion comprising a metal frame including a leading end configured to engage forward elements of a vehicle impacting the leading end; and (b) a base portion below and attached to the upper portion and configured to engage the road barrier in moveable relation along the road barrier, wherein said base portion comprises a pair of longitudinally corrugated base members positionable on opposite sides of a longitudinally corrugated guard rail.

8. The end piece of claim 7, in which the pair of base members are interconnectable to sandwich a guard rail between them.

9. An end piece for a road barrier extending longitudinally alongside a road, comprising:

(a) an upper portion having a notched end configured to trap a bumper or other forward element of an impacting vehicle; and (b) a base portion below and attached to the upper portion, wherein said base portion is mounted to the road barrier for slidable movement along the road barrier, wherein the upper portion is rotatably coupled to the base portion as to provide the upper portion with limited rotation relative to the base portion in a plane generally normal to a direction of travel of the base portion along the road barrier.

10. A traffic safety apparatus comprising:

(a) an elongated traffic barrier supported alongside a roadway, said barrier having an upstream end facing oncoming vehicles traveling on the roadway and including a W-shaped guardrail extending along the barrier;

(b) an end-piece positioned proximate the upstream end of the barrier and including an upper portion and a base portion attached to and below the upper portion, said base portion comprising a shoe movably mounted on said guardrail so as to be able to run along the guardrail, said shoe comprising a pair of interconnected W-shaped plates positioned on opposite sides of the guardrail;

(c) said upper portion including a leading end facing said oncoming vehicles and configured to hold such a vehicle impacting the upper portion in a manner restraining the vehicle from ramping or rolling; and (d) said base portion interconnecting said upper portion and the guardrail in a manner to be moveable along the guardrail in response to a vehicle impacting the leading end of the upper portion.

* * * * *